US006076665A

United States Patent [19]

Chuang

[11] Patent Number: 6,076,665

[45] Date of Patent: Jun. 20, 2000

[54] COMPACT TOOL HOLDER FOR DIFFERENT TOOLS

[76] Inventor: Louis Chuang, P.O. Box 63-247, 7th Floor—8, No. 20, Ta Lon Road, Taichung, Taiwan

[21] Appl. No.: 09/165,558

[22] Filed: Oct. 2, 1998

[51] Int. Cl.[7] ..... B65D 69/00

[52] U.S. Cl. ..... 206/234; 206/373; 206/493; 206/214; 81/438

[58] Field of Search ..... 206/234, 373, 206/372, 371, 370, 493, 37, 581, 214, 349, 443; 220/555; 81/437, 438, 439, 490, 177.4; 7/118, 151, 152, 156, 158, 164, 165

[56] References Cited

U.S. PATENT DOCUMENTS

| | | | |
|---|---|---|---|
| 707,901 | 8/1902 | Cheney | 81/490 |
| 4,501,361 | 2/1985 | Rose, Jr. | 206/493 |
| 4,562,923 | 1/1986 | Katada et al. | 206/235 |
| 4,779,493 | 10/1988 | White | 81/438 |
| 4,905,830 | 3/1990 | Lin | 206/362.2 |
| 5,058,465 | 10/1991 | Womack | 81/487 |
| 5,337,897 | 8/1994 | Yablans | 206/581 |
| 5,339,956 | 8/1994 | Thomason | 206/372 |
| 5,499,562 | 3/1996 | Feng | 81/177.4 |
| 5,621,936 | 4/1997 | Penaligon et al. | 7/151 |
| 5,782,150 | 7/1998 | Huang | 80/177.4 |
| 5,881,614 | 3/1999 | Cheng-Tsan | 81/438 |
| 5,887,306 | 3/1999 | Huang | 7/165 |

*Primary Examiner*—Paul T. Sewell
*Assistant Examiner*—Nhan T. Lam
*Attorney, Agent, or Firm*—Charles E. Baxley, Esq.

[57] ABSTRACT

A tool holder includes a casing having a number of receiving chambers defined therein for receiving tools of different functions. The casing further includes a holder chamber defined therein for receiving an end of one of the tools. A holder is mounted to the casing and includes an engaging end for releasably engaging with the end of a tool to be received in the holder chamber. The holder further includes a press end for disengaging the engaging end from the end of the tool to allow removal of the tool from the holder chamber.

19 Claims, 6 Drawing Sheets

COMPACT TOOL HOLDER FOR DIFFERENT TOOLS

BACKGROUND OF THE INVENTION

1. Field of the Invention

The present invention relates to a compact tool holder for receiving different tools of various functions.

2. Description of the Related Art

Tool holders often receive tools of the same function such that the users must prepare several tool holders for tools of different functions. Although tool holders for receiving different tools of a certain number of different functions have been proposed, the tool holders are relatively bulky and thus inconvenient to use and carry. More particularly, detachment or access of the tools is difficult and use of the tools is inconvenient. This greatly limits the utility of the tools and the tool holders. In addition, the tool holders usually have complicated structures and thus have a high cost in manufacture and assembly and have a high malfunction rate. The present invention is intended to provide an improved tool holder to solve the above problems.

SUMMARY OF THE INVENTION

A tool holder in accordance with the present invention comprises a casing including a plurality of receiving chambers defined therein for receiving tools of different functions. The casing further includes a holder chamber defined therein for receiving an end of one of the tools. In addition, a holder is mounted to the casing and includes an engaging end for releasably engaging with the end of a tool to be received in the holder chamber and means for disengaging the engaging end from the end of the tool to allow removal of the tool from the holder chamber.

In a preferred embodiment of the invention, each tool includes a V-shaped groove formed on a side thereof for releasable engagement with the engaging end of the holder. In addition, each tool includes a depression defined in a side thereof, and each receiving chamber includes a knurl for releasable engagement with the depression of the tool to be received in the receiving chamber.

Each tool may further include an enlarged head that is exposed outside the casing for easy removal of the tool. Each receiving chamber includes a notch defined in an outer edge thereof for receiving the enlarged head of the tool.

The holder may include a fixing rod mounted in the casing, a press end integral with the engaging end and the fixing rod, and an elastic leg integral with the engaging end and having an end attached to a bottom wall that defines the holder chamber. The tool received in the holder chamber is engaged with the engaging end and retained in place under the action of the elastic leg. The engaging end is disengaged from the tool received in the holder chamber when the press end is pressed.

The casing may further include a retainer plate extended on an outer side thereof and including a distal end having a distance from the outer side for holding a card or attached to a pocket. The casing may further include a hole to which a key ring is attached.

The casing may further include additional chambers for receiving a straight pin, a pair of tweezers, a shrinkage rule, a toothpick, and a writing instrument.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
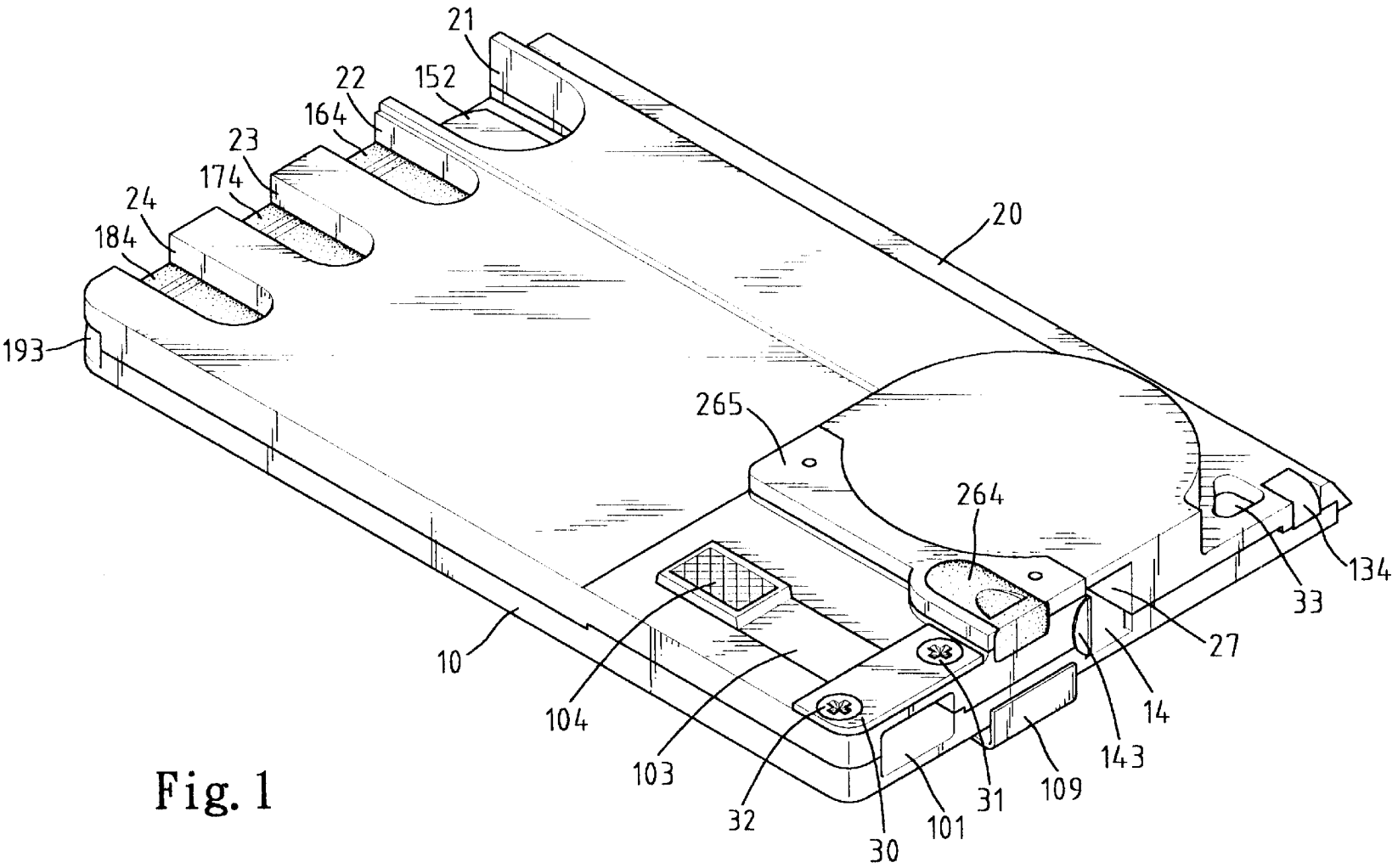
FIG. 1 is a perspective view of a tool holder in accordance with the present invention.
Figure 2:
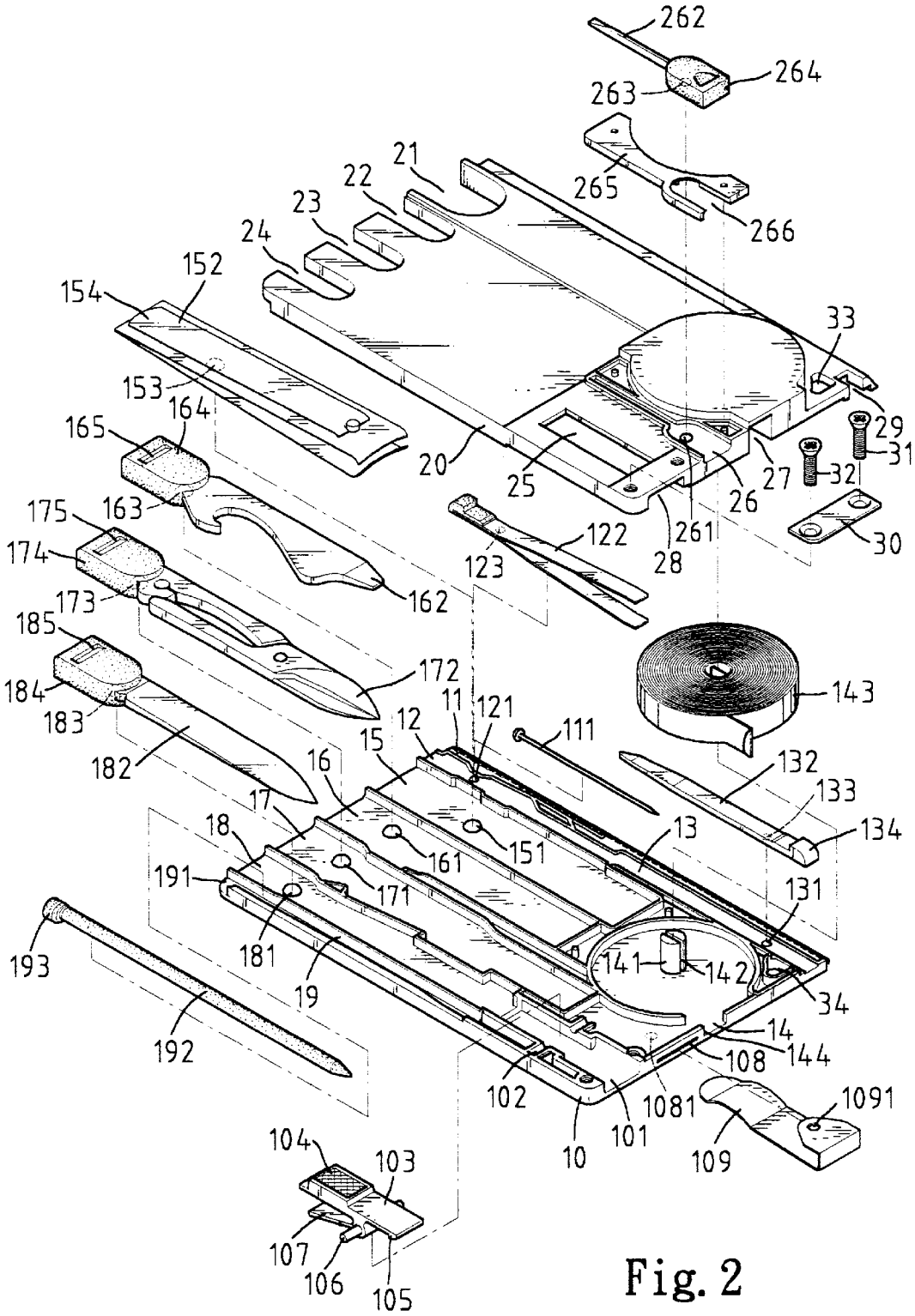
FIG. 2 is an exploded perspective view of the tool holder in accordance with the present invention.

Referring to the drawings and initially to FIGS. 1 and 2, a tool holder in accordance with the present invention generally includes an upper casing 20 and a lower casing 10. The lower casing 10 includes a number of receiving chambers defined in an upper side thereof. In this embodiment, the lower casing 10 includes a straight pin chamber 11 formed on a side thereof for receiving a straight pin 111. Adjacent to the chamber 11 is a tweezers chamber 12 for receiving a pair of tweezers 122. One of two legs (not labeled) or a head portion (not labeled) of the pair of tweezers 122 includes a depression 123 for releasable engagement with a knurl 121 formed on a bottom wall that defines the chamber 12. Aligned with the chamber 12 is a toothpick chamber 13 for receiving a toothpick 132. A head portion 134 of the toothpick 132 includes a depression 133 for releasable engagement with a knurl 131 formed on a bottom wall that defines the chamber 13. In addition, the head portion 134 of the toothpick 132 may be enlarged for easy grasp.

Adjacent to the chamber 13 is a circular rule chamber 14 for receiving a shrinkage rule 143. A bottom wall of the chamber 14 includes a peg 141 formed thereon. The peg 141 includes a slit 142 defined therein for receiving an inner end of the shrinkage rule 143. The lower casing 10 further includes a notch 144 defined in a periphery thereof and communicated with the chamber 14 such that an outer end of the shrinkage rule 143 is extended through the notch 144 and retained outside the casings 10 and 20.

Adjacent to the chamber 12 is a nail-scissors chamber 15 for receiving a pair of nail scissors 152. The pair of tweezers 152 includes a depression 153 for releasable engagement with a knurl 151 formed on a bottom wall that defines the chamber 15. Adjacent to the chamber 15 is a bottle/can opener chamber 16 for receiving a bottle/can opener 162. A handle 164 of the bottle/can opener 162 includes a depression 163 for releasable engagement with a knurl 161 formed on a bottom wall that defines the chamber 16. In addition, the handle 164 of the bottle/can opener 162 includes a substantially V-shaped groove 165 defined in a side thereof, which will be described later. Adjacent to the chamber 16 is a scissors chamber 17 for receiving a pair of scissors 172. A handle 174 of the pair of scissors 172 includes a depression 173 for releasable engagement with a knurl 171 formed on a bottom wall that defines the chamber 17. In addition, the handle 174 of the pair of scissors 172 includes a substantially V-shaped groove 175 defined in a side thereof, which will be described later.

Adjacent to the chamber 17 is a blade chamber 18 for receiving a blade 182. A handle 184 of the blade 182 includes a depression 183 for releasable engagement with a knurl 181 formed on a bottom wall that defines the chamber 18. In addition, the handle 184 of the blade 182 includes a substantially V-shaped groove 185 defined in a side thereof, which will be described later. Formed on the other side of the lower casing 10 and adjacent to the chamber 18 is a writing instrument chamber 19 for receiving a writing instrument, e.g., a ball-point-pen 182 or a pen. An end of the chamber 19 further includes a notch 191 for retaining an enlarged head 193 of the ball-point-pen.

The lower casing 10 further includes a slot 108 defined in a side thereof for receiving a section of a substantially "7"-shaped or U-shaped retainer plate 109. The other section of the retainer plate 109 is resilient and exposed outside the lower casing for holding a card between an outer side of the lower casing and the other section of the retainer plate 109. In addition, the retainer plate 109 may be attached to a pocket (not shown) of, e.g., a shirt worn on the user and thus is easy-to-carry.

The tool holder further includes a holder chamber 101 for receiving a holder 103. The holder 103 includes a fixing rod 106 securely received in a receiving groove 102 of the lower casing 10, an engaging end 105 formed on a side of the fixing rod 106 for releasably engaging a tool, an elastic leg 107 that has a first end connected to the fixing rod 106 and a second end bears against a bottom wall that defines the chamber 101, and a press end 104 having a first end integral with (or connected to) the engaging end 105 and a second end exposed outside the upper and lower casings 20 and 10.

Figure 3:
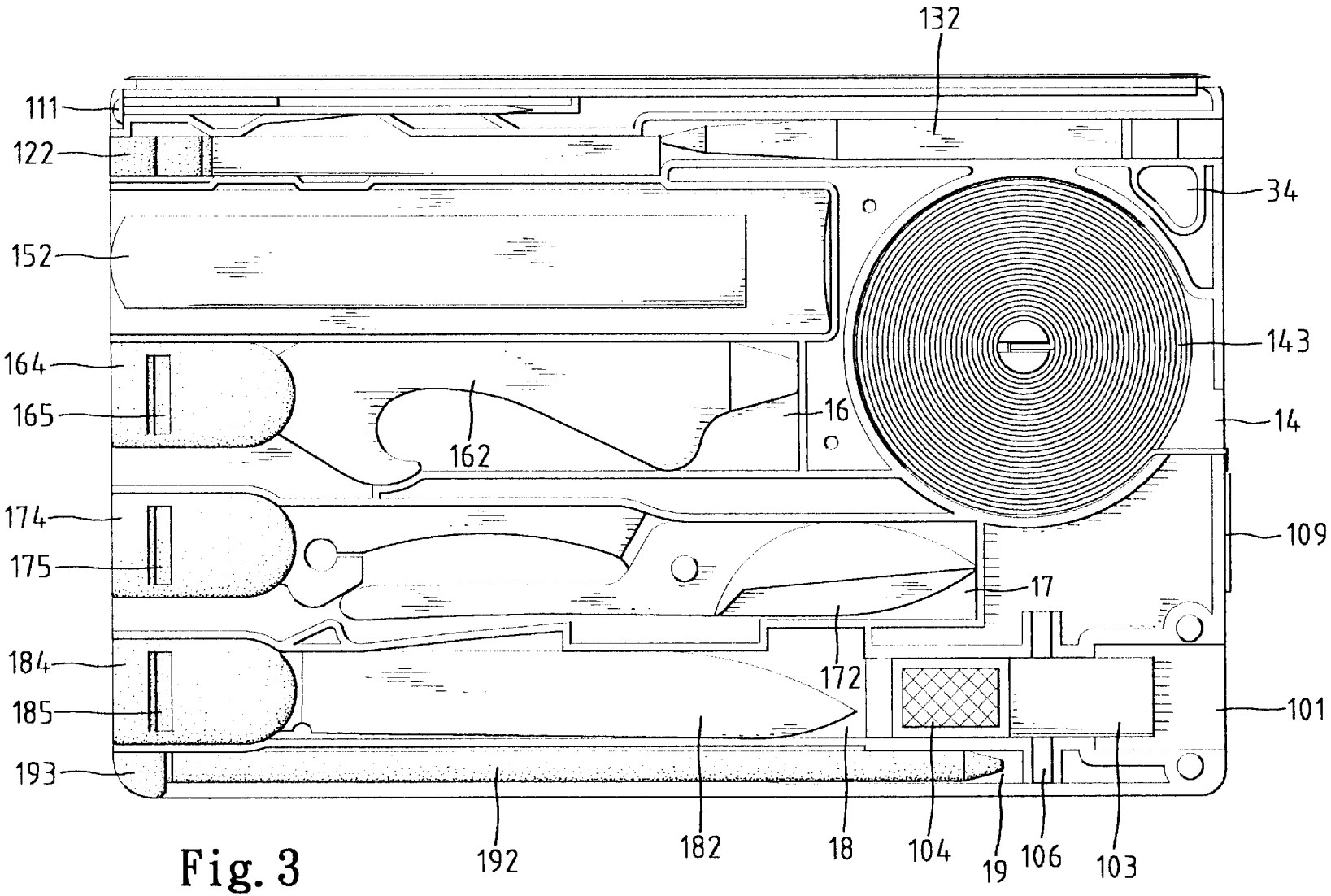
FIG. 3 is a top view of the tool holder and tools received in of the tool holder in accordance with the present invention, wherein an upper cover of the tool holder is removed for clarity.
Figure 4:
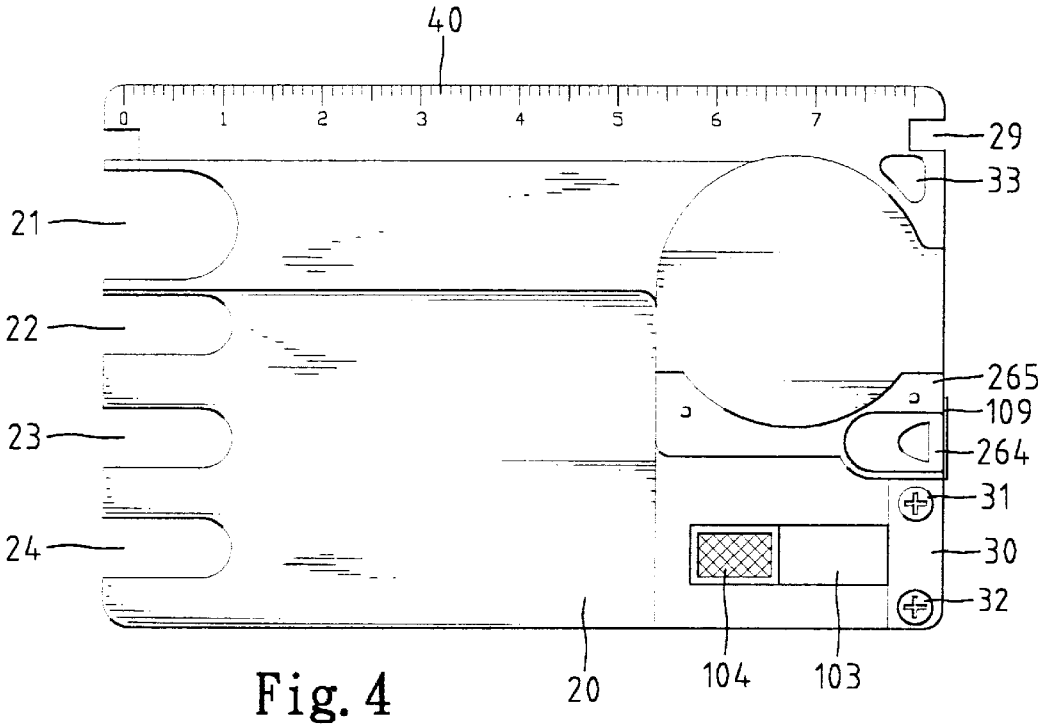
FIG. 4 is a top view of the upper cover of the tool holder in accordance with the present invention.

Reception of the tools is illustrated in FIG. 3 in which the upper cover is removed for clarity. Referring to FIG. 4, the upper casing 20 is as large as the lower casing 10 and includes a number of notches 21, 22, 23, 24 defined in a side thereof such that the handles 154, 164, 174, and 184 respectively of the nail scissors 152, the bottle/can opener 162, the pair of scissors 172, and the blade 182 are exposed for manual removal. As shown in FIGS. 1, 2, and 4, the upper casing 20 further includes a screwdriver chamber 26 defined in an upper side thereof for receiving a screwdriver 262. A handle 264 of the screwdriver 262 includes a depression 263 for releasable engagement with a knurl 261 formed on a bottom wall that defines the chamber 26. A screwdriver cover 265 is mounted to the upper side of the upper casing 20 to cover the chamber 26. The screwdriver cover 265 includes a notch 266 such that the head 264 is exposed to allow easy manual removal of the screwdriver 262. The upper side of the upper casing 20 may further include a metric scale 40 and thus can serve as a metric ruler. The upper casing 20 further includes a notch 27 that allows operation of the shrinkage rule 143. The upper casing 20 further includes an access 28 defined in a side thereof and communicated with the holder chamber 101 when assembled with the lower casing 10. In addition, a notch 29 is defined in a side of the upper casing 20 such that the head 134 of the toothpick 132 is exposed for easy manual removal of the toothpick 132. A metallic reinforcing plate 30 may be attached to the upper casing 20 by screws 31 and 32 to reinforce the structure. Furthermore, the upper casing 20 and the lower casing 10 may include aligned holes 33 and 34 to which a key ring (not shown) is attached. The size of the resultant tool holder may be as large as a cardholder for ease of carriage.

Figure 5:
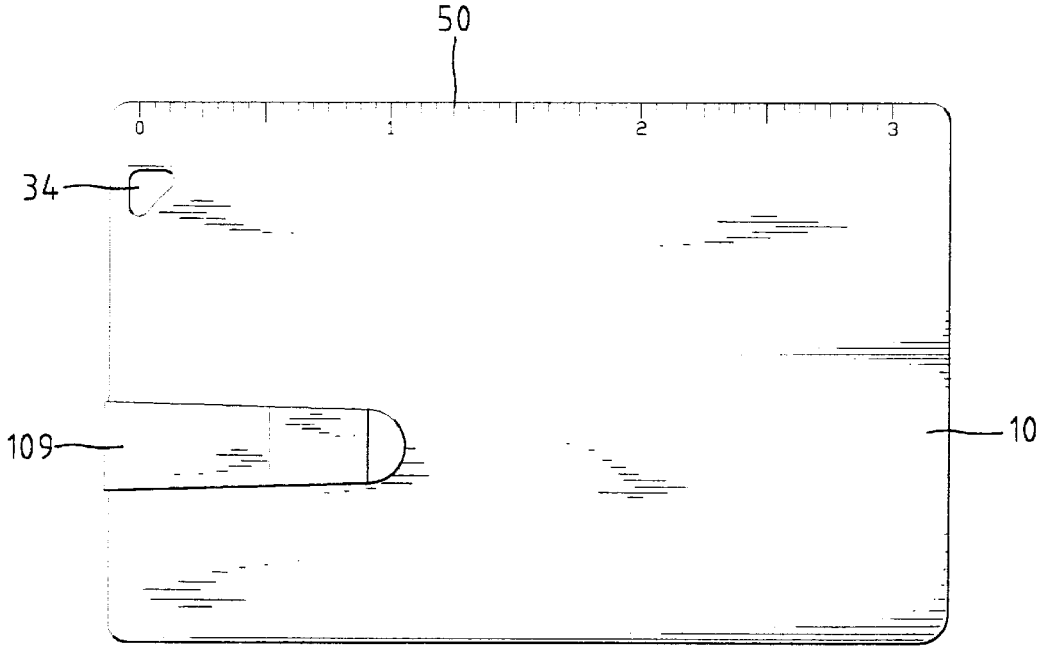
FIG. 5 is a bottom view of a lower cover of the tool holder in accordance with the present invention.

Referring to FIG. 5, the lower casing 10 may include an inch scale 50 on a bottom side thereof and thus can serve as an inch ruler.

Figure 6:
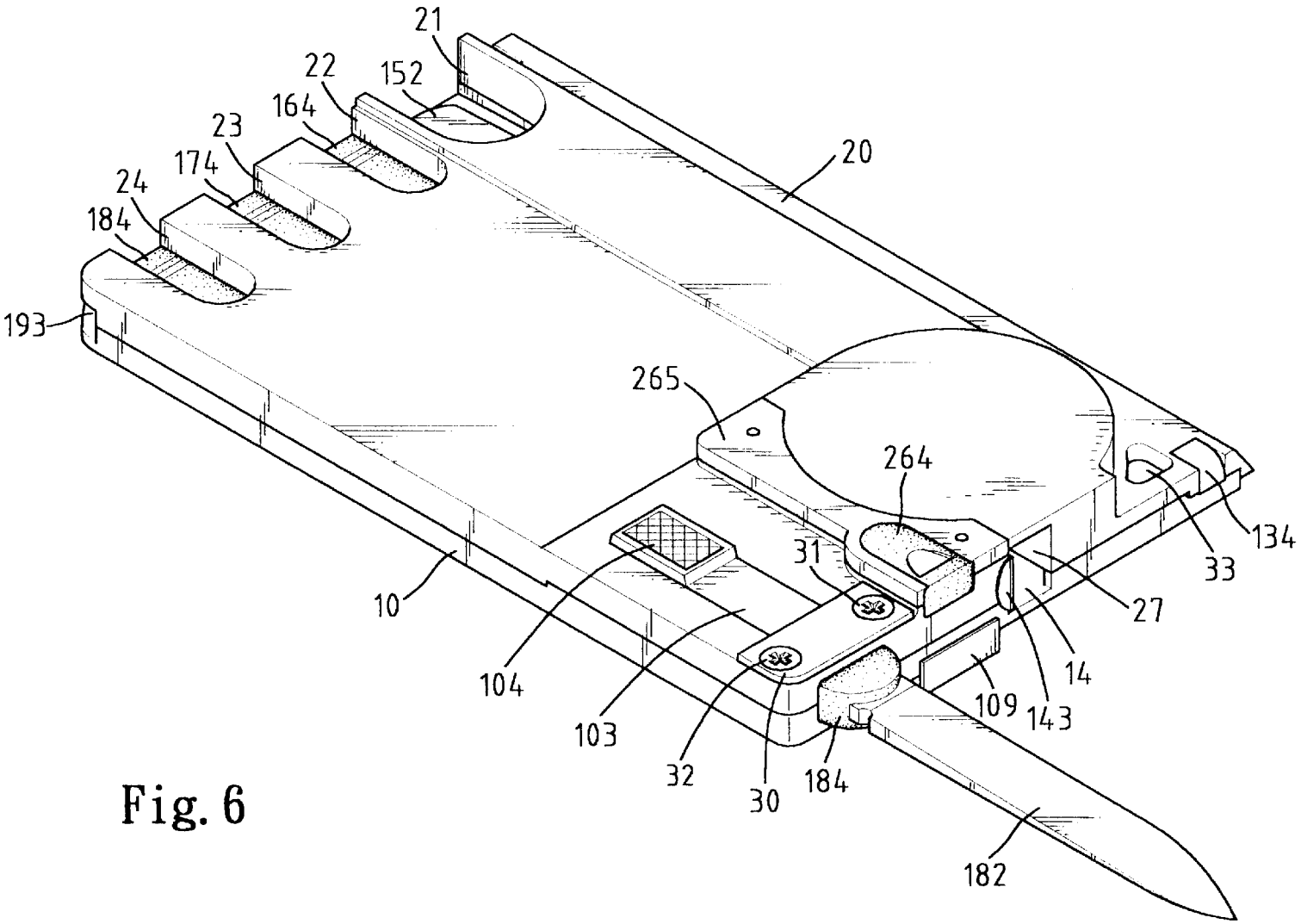
FIG. 6 is a perspective view illustrating use of the tool holder in accordance with the present invention.
Figure 7:
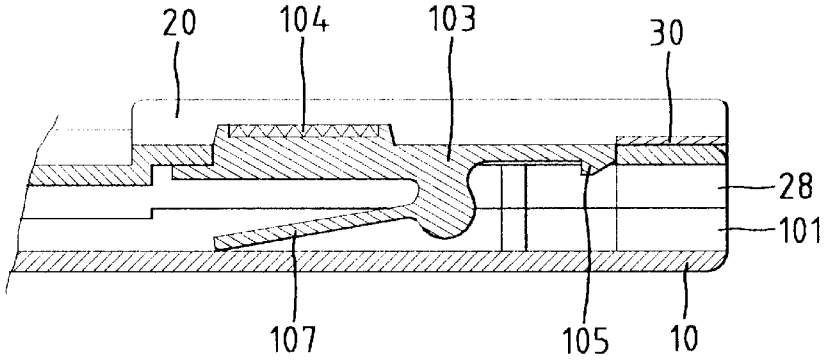
FIG. 7 is a partial sectional view of a portion of the tool holder in accordance with the present invention.
Figure 8:
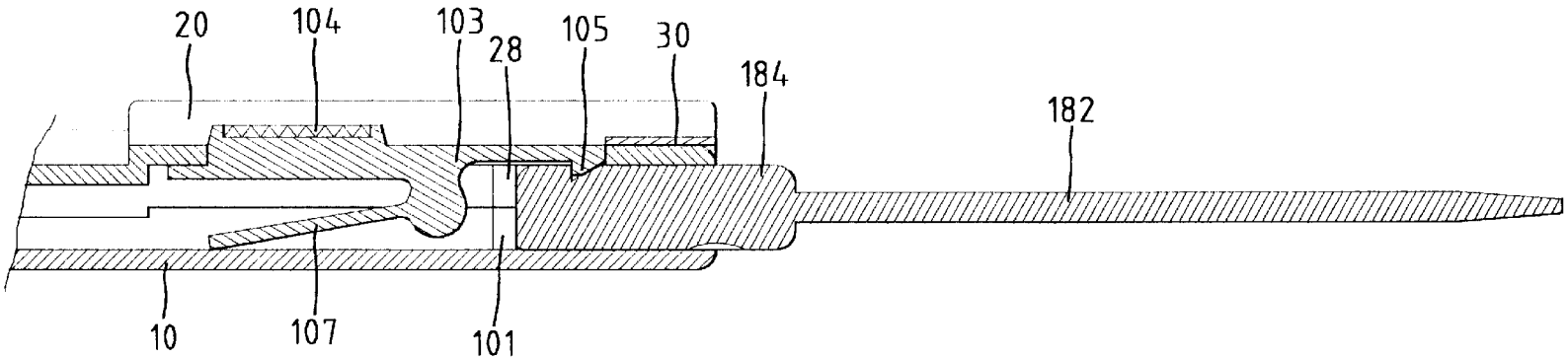
FIG. 8 is a partial sectional view similar to FIG. 7, illustrating use of the tool holder in accordance with the present invention.

When using, e.g., the blade 182, the user may grasp the handle 184 of the blade 182 and remove the blade 182 from its chamber 18 (Fig.3). Then, the handle 184 is inserted into the holder chamber 101 until the V-shaped groove 184 is engaged with the hook 105 (compare FIGS. 7 and 8). The blade 182 is retained in place by the engaging end 105 of the holder 103 under the action of the elastic leg 107 (FIGS. 6 and 8). Thus, the blade 182 is provided with a longer operative arm for operation. Removal of the blade 182 can be easily accomplished by pressing the press end 104 and removing the blade 182 from the compartment 101, as the engaging end 105 of the holder 103 is disengaged from the V-shaped groove 184. Thereafter, the blade 182 can be directly inserted into its chamber 18 for storage. Provision of the knurl 181 and the depression 183 allows easy engagement and disengagement therebetween. It is appreciated that operation and use of the pair of scissors 172 and the bottle/can opener 162 are identical to those of the blade 182 and therefore not further described to avoid redundancy. In addition, the head 264 of the screwdriver 264 may also include a V-shaped groove (not shown) so as to be releasably engaged in the chamber 101 to have a longer operative arm.

According to the above description, it is appreciated that the tool holder of the present invention may receive tools of different functions in a compact manner, and the tools can be attached to the tool holder to have a longer operative arm for convenient operation.

Although the invention has been explained in relation to its preferred embodiment, it is to be understood that many other possible modifications and variations can be made without departing from the spirit and scope of the invention as hereinafter claimed.

What is claimed is:

1. A combination of a tool holder and a plurality of tools of different functions, the tool holder comprising:

a casing including a plurality of receiving chambers defined therein for receiving the tools of different functions, the casing further including a holder chamber defined therein for releasably receiving an end of one of the tools to be used, and a holder mounted to the casing and including an engaging end for releasably engaging with the end of said one of the tools received in the holder chamber and means for disengaging the engaging end from the end of said one of the tools received in the holder chamber to allow removal of said one of the tools from the holder chamber, the holder including a fixing rod mounted in the casing, a press end integral with the engaging end and the fixing rod, and an elastic leg integral with the engaging end and having an end attached to a bottom wall that defines the holder chamber, whereby said one of the tools received in the holder chamber is engaged with the engaging end of the holder and retained in place under the action of the elastic leg, and whereby the engaging end of the holder is disengaged from said one of the tools received in the holder chamber when the press end is pressed.

2. The combination according to claim 1, wherein each said tool includes a groove formed on a side thereof for releasable engagement with the engaging end of the holder.

3. The combination according to claim 1, wherein each said tool includes a depression defined in a side thereof, and each said receiving chamber includes a knurl for releasable engagement with the depression of an associated said tool to be received in the receiving chamber.

4. The combination according to claim 1, wherein each said tool further includes an enlarged head that is exposed outside the casing for easy removal of the tool.

5. The combination according to claim 4, wherein each said receiving chamber includes a notch defined in an outer edge thereof for receiving the enlarged head of an associated said tool.

6. The combination according to claim 1, wherein the casing further includes a retainer plate extended on an outer side thereof and including a distal end having a distance from the outer side.

7. The combination according to claim 1, wherein the casing further includes a chamber for receiving a straight pin.

8. The combination according to claim 1, wherein the casing further includes a chamber for receiving a pair of tweezers.

9. The combination according to claim 1, wherein the casing further includes a chamber for receiving a shrinkage rule.

10. The combination according to claim 1, wherein the casing further includes a chamber for receiving a toothpick.

11. The combination according to claim 1, wherein the casing further includes a hole to which a key ring is adapted to be attached.

12. The combination according to claim 1, wherein the casing further includes a chamber for receiving a writing instrument.

13. A combination of a tool holder and a plurality of tools of different functions, the tool holder comprising:

a casing including a plurality of receiving chambers defined therein for receiving the tools of different functions, the casing further including a holder chamber defined therein for releasably receiving an end of one of the tools to be used, and a holder mounted to the casing and including an engaging end for releasably engaging with the end of said one of the tools received in the holder chamber and means for disengaging the engaging end from the end of said one of the tools received in the holder chamber to allow removal of said one of the tools from the holder chamber, wherein the other end of said one of the tools received in the holder chamber extends beyond the casing for operation when the end of said of the tools received in the holder chamber engages with the engaging end of the holder while the casing acts as a handle.

14. The combination according to claim 13, wherein each said tool includes a groove formed on a side thereof for releasable engagement with the engaging end of the holder.

15. The combination according to claim 13, wherein each said tool includes a depression defined in a side thereof, and each said receiving chamber includes a knurl for releasable engagement with the depression of an associated said tool to be received in the receiving chamber.

16. The combination according to claim 13, wherein each said tool further includes an enlarged head that is exposed outside the casing for easy removal of the tool.

17. The combination according to claim 16, wherein each said receiving chamber includes a notch defined in an outer edge thereof for receiving the enlarged head of an associated said tool.

18. The combination according to claim 13, wherein the holder includes a fixing rod mounted in the casing, a press end integral with the engaging end and the fixing rod, and an elastic leg integral with the engaging end and having an end attached to a bottom wall that defines the holder chamber, whereby the tool received in the holder chamber is engaged with the engaging end and retained in place under the action of the elastic leg, and the engaging end of the holder is disengaged from the tool received in the holder chamber when the press end is pressed.

19. The combination according to claim 13, wherein the casing further includes a retainer plate extended on an outer side thereof and including a distal end having a distance from the outer side.

* * * * *